US005121793A

United States Patent [19]

Busch et al.

[11] Patent Number: 5,121,793

[45] Date of Patent: Jun. 16, 1992

[54] CAPPING EQUIPMENT FOR BLOWOUT WELL

[75] Inventors: Jean-Charles Busch, Montfort l'Amaury; Yannick Guerrini, Saint-Germain en Laye; Jean Tag, Arthez de Bearn; Joseph Carrau, Mourenx, all of France

[73] Assignees: Societe Nationale Elf Aquitaine (Production); Gaz de France, both of France

[21] Appl. No.: 646,623

[22] PCT Filed: Apr. 2, 1990

[86] PCT No.: PCT/FR90/00229

§ 371 Date: Jan. 31, 1991

§ 102(e) Date: Jan. 31, 1991

[87] PCT Pub. No.: WO90/12194

PCT Pub. Date: Oct. 18, 1990

[30] Foreign Application Priority Data

Apr. 3, 1989 [FR] France ..... 89 04348

[51] Int. Cl.[5] ..... E21B 33/03; E21B 35/00; E21B 43/12

[52] U.S. Cl. ..... 166/79; 166/92; 166/95; 166/97

[58] Field of Search ..... 166/92, 95, 97, 75.1, 166/85, 364, 363, 96, 79

[56] References Cited

U.S. PATENT DOCUMENTS

| | | | |
|---|---|---|---|
| 1,664,643 | 4/1928 | Rasmussen | 166/92 |
| 1,758,453 | 5/1930 | Mays | 166/92 X |
| 1,828,124 | 10/1931 | Bower | 166/69 |
| 2,793,700 | 5/1957 | Eckel | 166/95 |
| 2,897,895 | 8/1959 | Ortloff | 166/75.1 X |
| 3,316,963 | 5/1967 | Boldrick et al. | 166/85 X |
| 4,026,354 | 5/1977 | Burrow | 166/95 |
| 4,359,089 | 11/1982 | Strate et al. | 166/79 |
| 4,423,774 | 1/1984 | Mefford | 166/92 X |
| 4,461,354 | 7/1984 | Buras et al. | 166/85 X |

FOREIGN PATENT DOCUMENTS

| | | | |
|---|---|---|---|
| 2393223 | 12/1978 | France . | |
| 170440 | 5/1965 | U.S.S.R. | 166/92 |
| 1266970 | 10/1986 | U.S.S.R. | 166/364 |
| 1286734 | 1/1987 | U.S.S.R. | 166/79 |
| 1314009 | 5/1987 | U.S.S.R. | 166/97 |

*Primary Examiner*—Hoang C. Dang
*Attorney, Agent, or Firm*—Bacon & Thomas

[57] ABSTRACT

Device for blocking off a well in open flow which includes a blocking system (4) for blocking off the well, an anchorage system (3) to support said blocking system (4) and a movable and inclinable support and positioning system (5) which comprises a sliding ramp (6) and mechanism for moving the blocking system (4) to bring it above the end of the casing (2) to be blocked off. Application: exploration, production and storing of hydrocarbons.

16 Claims, 7 Drawing Sheets

Figure 1:
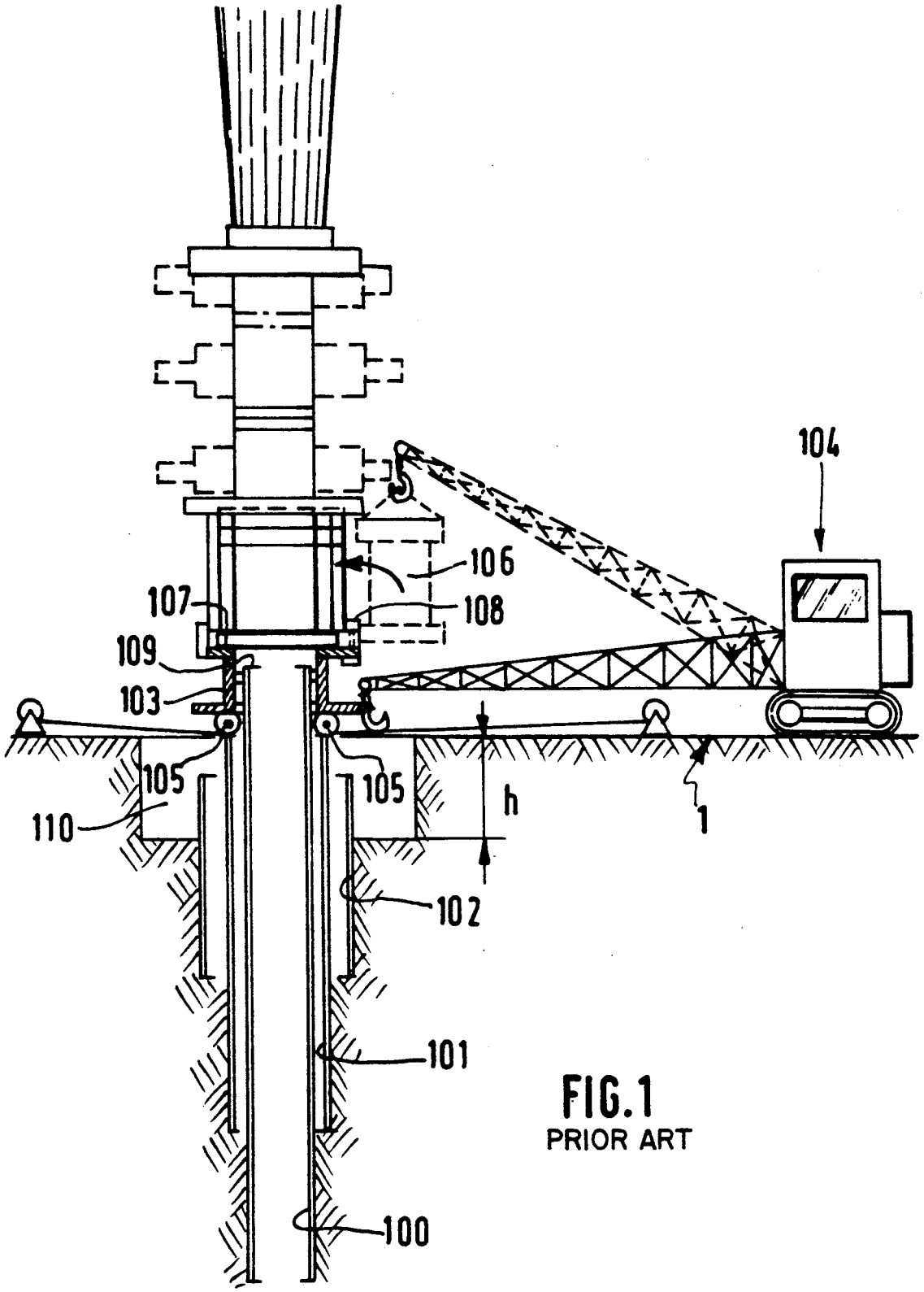
FIG.1 PRIOR ART

2
3
4
5
6
7
19
22
50
51
52
53
54
55
56
57
58
59
60

CAPPING EQUIPMENT FOR BLOWOUT WELL

The present invention concerns capping equipment for a blowout well.

Whether it be an exploration, or production or even a storage site of hydrocarbons, whether oil or gas be involved, whether it be on shore or off, accidental, uncontrolled and powerful accidental leaks of hydrocarbons may take place, with or without fires.

An end must be put as soon as possible to this highly dangerous and greatly damaging situation by placing effective sealing means on the blowout conduit.

In the illustrative case of an on-shore production well. as a rule two parts are involved: a first part consisting of an assembly of underground casings joined at the top into a system called casing liner; a second assembly at the surface and consisting of a plurality of valves usually called the "Christmas tree": this is the top of the producing well.

In the prior art, a first method is used especially for the uncontrolled blowouts on off-shore or on-shore sites, namely in setting up a distance away one or more directional drillings to arrive at the producing deposit site. This procedure requires transporting and setting up one or more drilling rigs and all the pertinent logistics. This is a costly solution because of long and cumbersome methods to stop this blowout.

Another known method on blowout sites consists of ridding the well approaches of the superfluous structures (liner head, production head) and then clearing part of the casing to a sufficient height to thereupon make possible the anchoring of mechanical means designed to support new seals. For that purpose, part of the intermediate string is cleared, enlarging the pit if necessary, then an anchoring collar is placed on the production casing by means of flanges. This collar also includes sealing means. Next, using a vehicle such as a caterpillar with at least one supporting beam and equipped with a system of cables and pulleys, one of the components of the sealing system is placed on the anchoring collar. This sealing element is affixed to the edge of the anchoring collar in one place using bolts and nuts. Next, by means of the transport and handling vehicle, the sealing system is moved horizontally from the upper surface of the anchoring collar in such a manner as to move it in sliding rotation around the aforementioned affixation point opposite the axis of the casing which must be sealed. Again the means for positioning the sealing system are crude and conventional pulley means. Once in place, the anchoring brackets are moved and locked. The set of locking and clamping systems of the nut and bolt type etc. amount to as many human interventions which are very difficult and very dangerous even if the flame was blown out before the diverse sealing means were put in place or if the jet is so strong that sufficient height is left between the ground and the flame to operate the various mechanisms while using conventional protective gear for the operators.

A major drawback of this procedure and this equipment derives from the human presence required to carry out the affixing and locking operations of the positioning and anchoring elements of the sealing system. Such dangers increase furthermore in the presence of blowout wells with acid gases.

The object of the present invention is to provide capping equipment for a freely gushing well without any human intervention in the immediate vicinity of the well. Another object of the invention is to design such equipment so it can meet all freely gushing situations whether the blowout be gaseous or liquid, at an on-shore or off-shore site, with a minimum of equipment adaptation to the particular situation being needed.

Another object yet is to have such equipment available in reserve to be able to rapidly intervene, in view of the ease of disassembly of its components and of transporting it because of such flexibility.

Again an object of the invention is to design such equipment which can easily match various sealing diameters.

To meet these various objectives, the capping equipment of the invention comprises the following means:

a well-capping system to seal the well, a system anchoring on the well to support the capping system in its capping position, a movable and inclinable positioning and support system for the capping system and comprising a slide ramp, means for moving the capping system on this slide ramp, and means for pivoting said capping system and moving it above the end of the casing which must be sealed, the means for locking the anchoring system, for displacing, pivoting, positioning and anchoring the capping system being remote-controlled fluid systems.

In a first embodiment mode of the invention, the equipment comprises:

an anchoring system to the well, locked onto the best and strongest or median part of the cleared end of the casing of the blowout well, a well-capping system to seal the well, placed in the capping position on said anchoring system, a mobile and inclinable support system positioning said capping system on said casing, comprising a slide ramp, displacement means controlled remotely from said capping system on said slide ramp, and means remote-controlled pivoting said slide ramp about a stationary component rigidly joined to the anchoring system, the means locking the anchoring system onto the casing, the means for displacing, pivoting, anchoring and sealing the capping system on the casing as well as the means inclining said positioning and support means being hydraulic means (more generally, fluid means), all remote-controlled.

The stationary component rigidly joined to the well consists of two cylindrically aligned shafts in sideways extension of said anchoring system and on which rest and cooperate the ends of the displacement means of the capping system. In this manner the capping-system displacement means rest against the anchoring system.

Preferably the anchoring system shall include a support collar providing the emplacement plane for an anchoring collar on the casing.

Preferably again the anchoring collar on the casing consists of two parts:

a lower and an upper anchoring collar, the two collars being affixed to the casing by chock-anchoring, said chocks being driven by remote-controlled hydraulic jacks.

The capping system comprises a capping bell with anchoring flanges and serves to support the sealing means, further including stoppers on the casing.

Furthermore remote-controlled hydraulic-jack locking means are present to affix the capping bell supporting the sealing means on the casing to the anchoring collar, more specifically by the locking jacks rigidly joined to the upper anchoring collar acting on the anchoring collar in the form of flange assembly of the capping bell.

The sealing means are known per se of the "blow-out preventer" type. All types with their prescribed diameters are suitable.

In the invention, the positioning and support system of the capping system consists of an inclinable and mobile slide ramp mounted on a brace and a stay, the two components hinging on an anchoring point rigidly joined to a base plate applied against the ground. This base plate by means of its footing provides the support stability and also avoids generating a bending torque on this part of the casing.

The displacement means of the capping system on the slide ramp also consist of jacks of which the free ends rest against the stationary component of the anchoring system.

The free jack ends are brackets resting against the stationary components of the anchoring system, to wit, the extensions or aligning shafts of the anchoring collar. Such a design allows pivoting the capping-system assembly around said shafts by means of the bracket hinges of the free jack ends.

The means with which to pivot the slide ramp around the stationary component of the anchoring system are pivoting jacks mounted by one of their ends to a hinge rigidly joined to the slide ramp.

In a second embodiment of the invention, the anchoring system and the capping system are mounted jointly on the slide ramp and the inclinable and mobile system supporting them is mounted on a displaceable frame which thereby allows moving the equipment in front of the jet.

In this variation, a clamped junction rigidly connected to the front end of the frame allows clamping the casing to be sealed.

This clamped junction advantageously consists of a housing with an access gate of which the arbitrary, hydraulically controlled closure allows affixing the equipment to the casing.

Other features and advantages of the invention are elucidated in the description below of an illustrative but non-restrictive embodiment of the invention shown in relation to the drawing.

Figure 2:
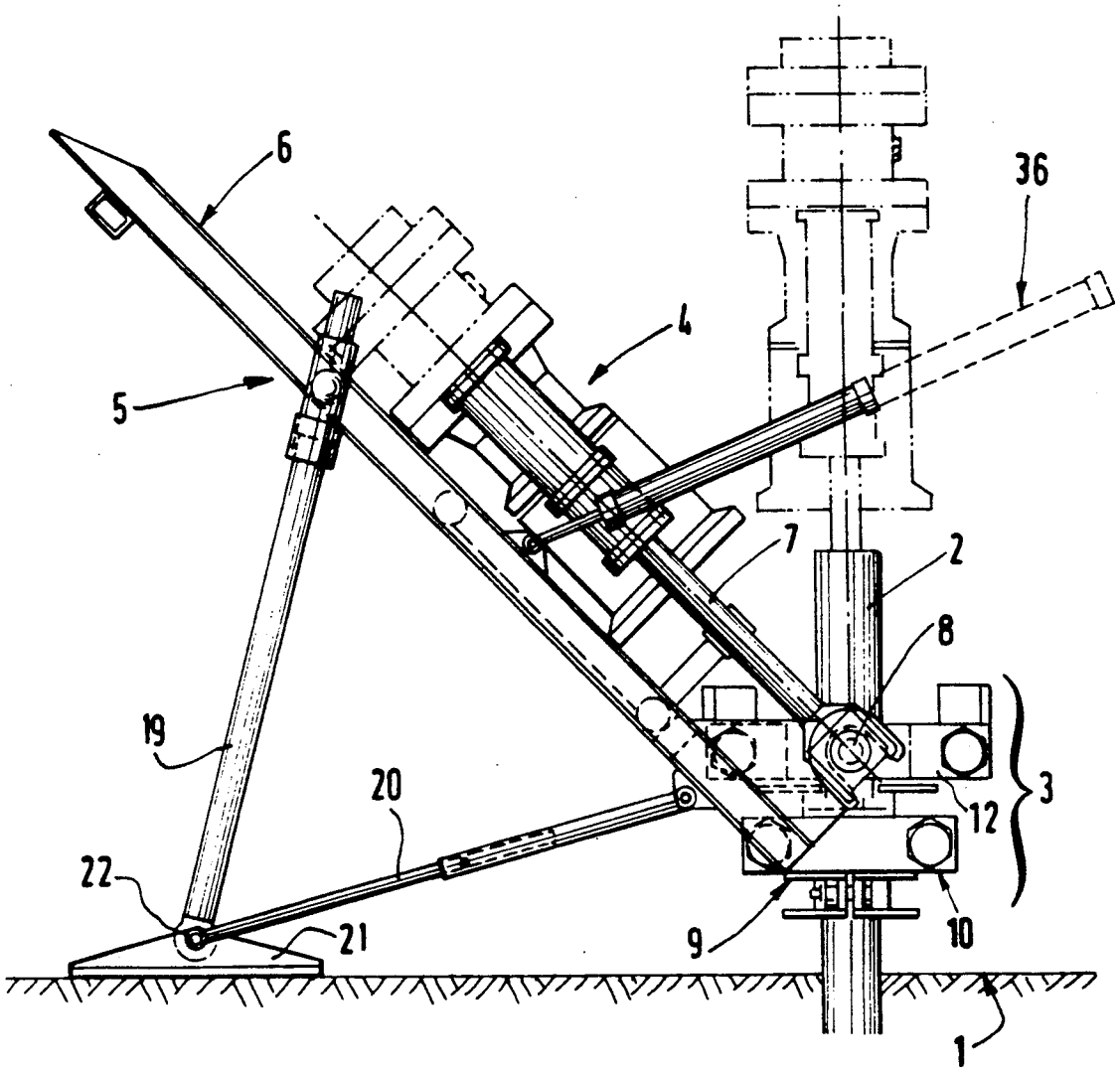
Figure 3A:
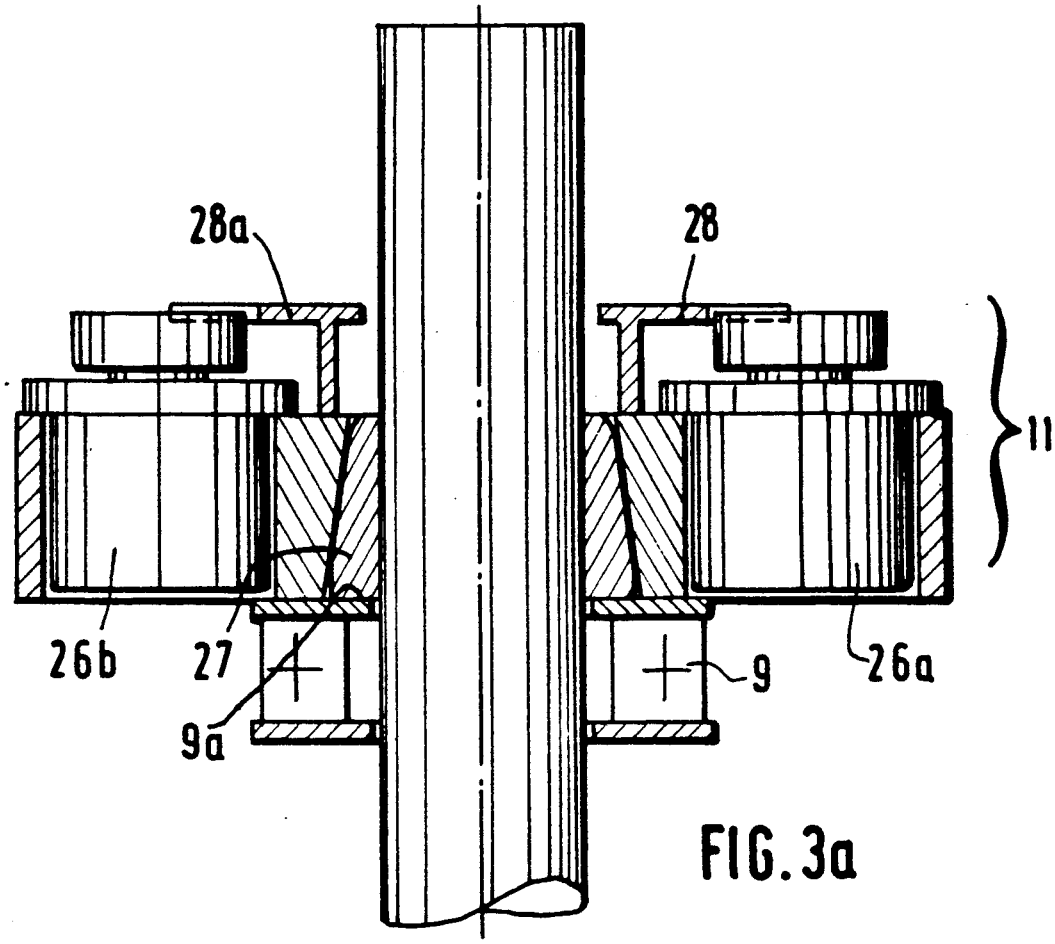
Figure 3B:
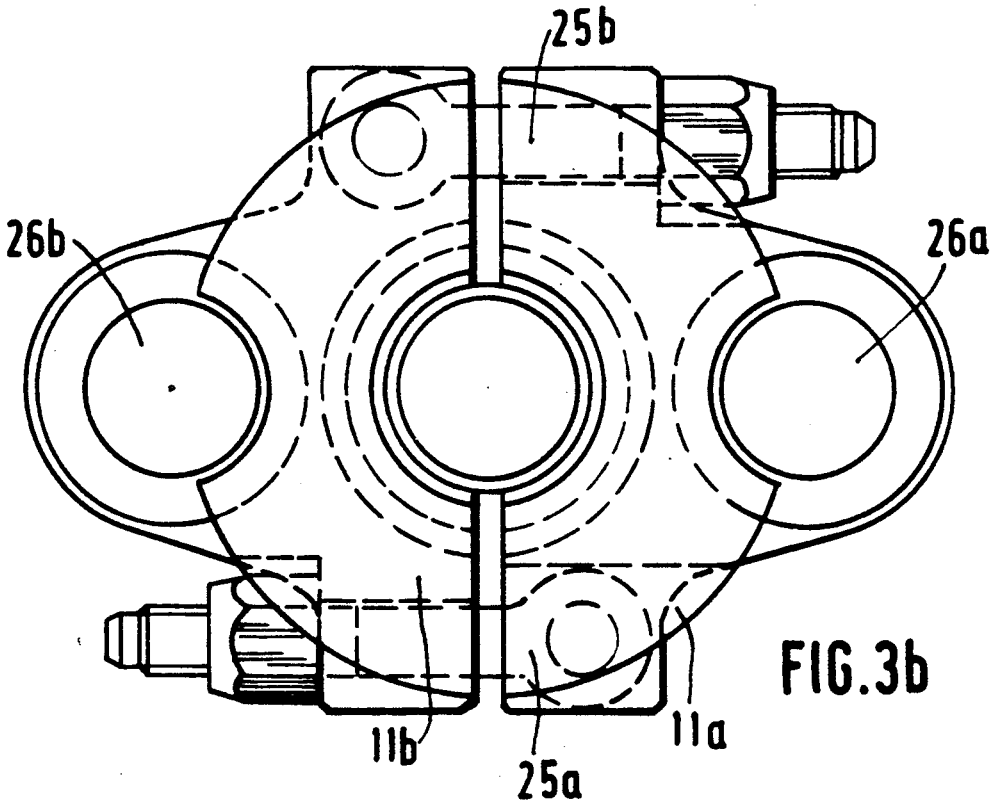
Figure 4A:
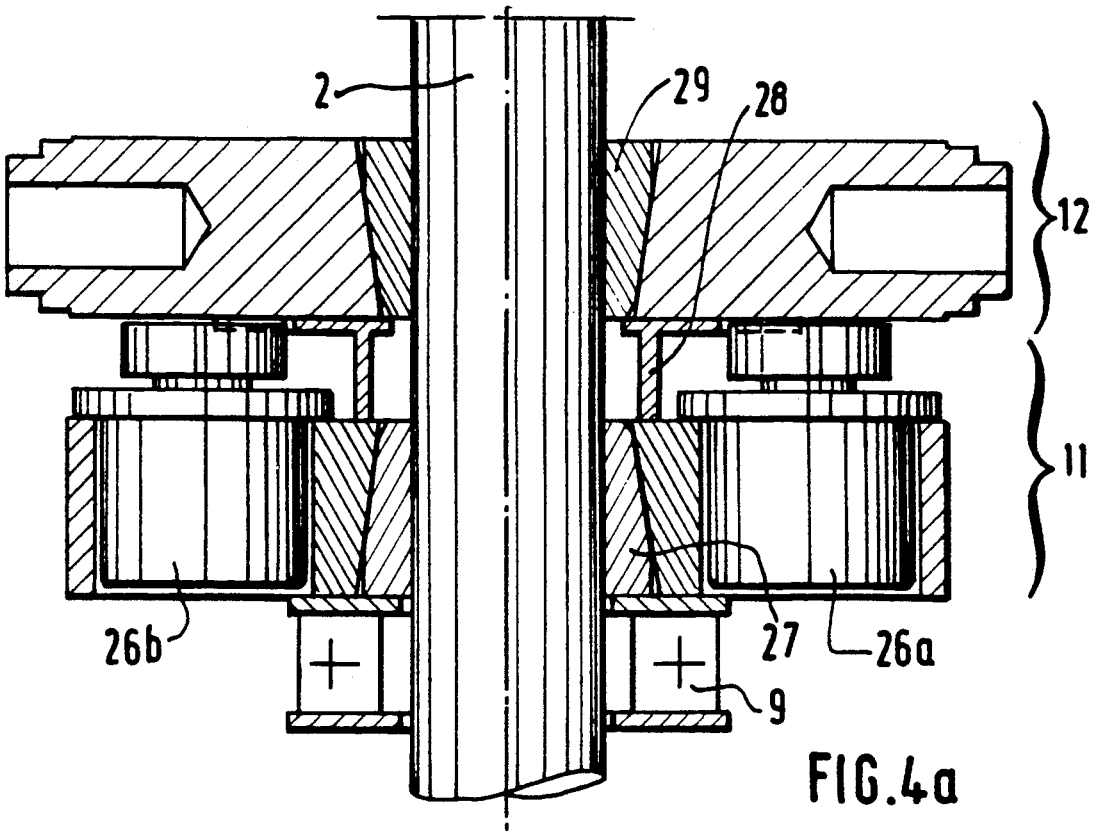
Figure 4B:
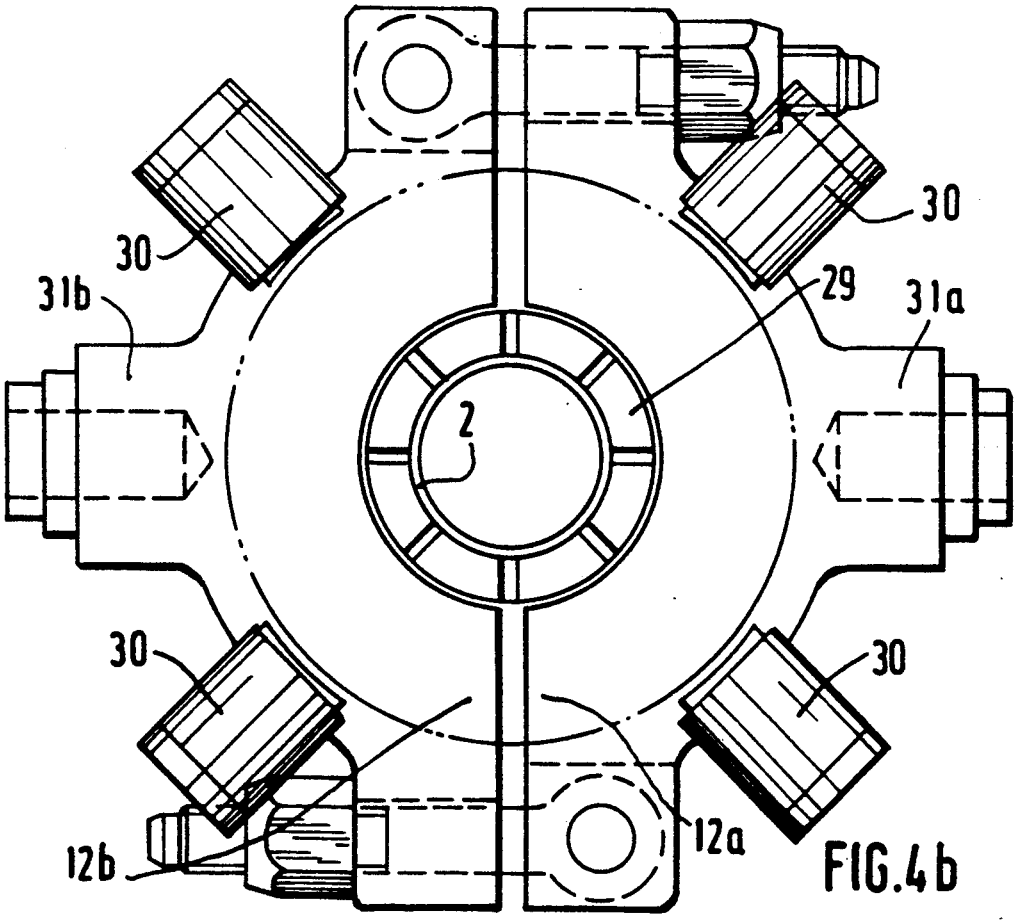
Figure 5:
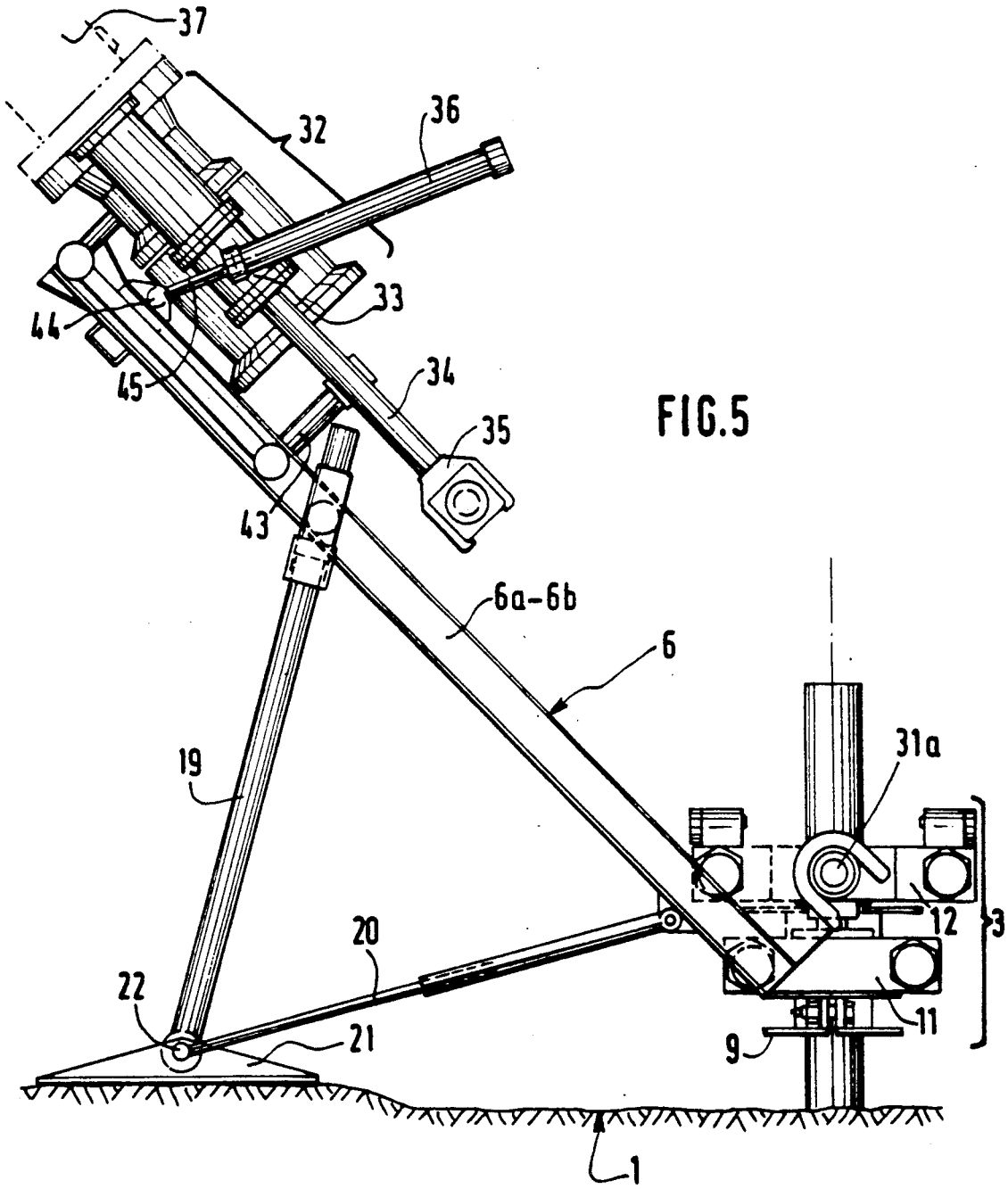
Figure 6:
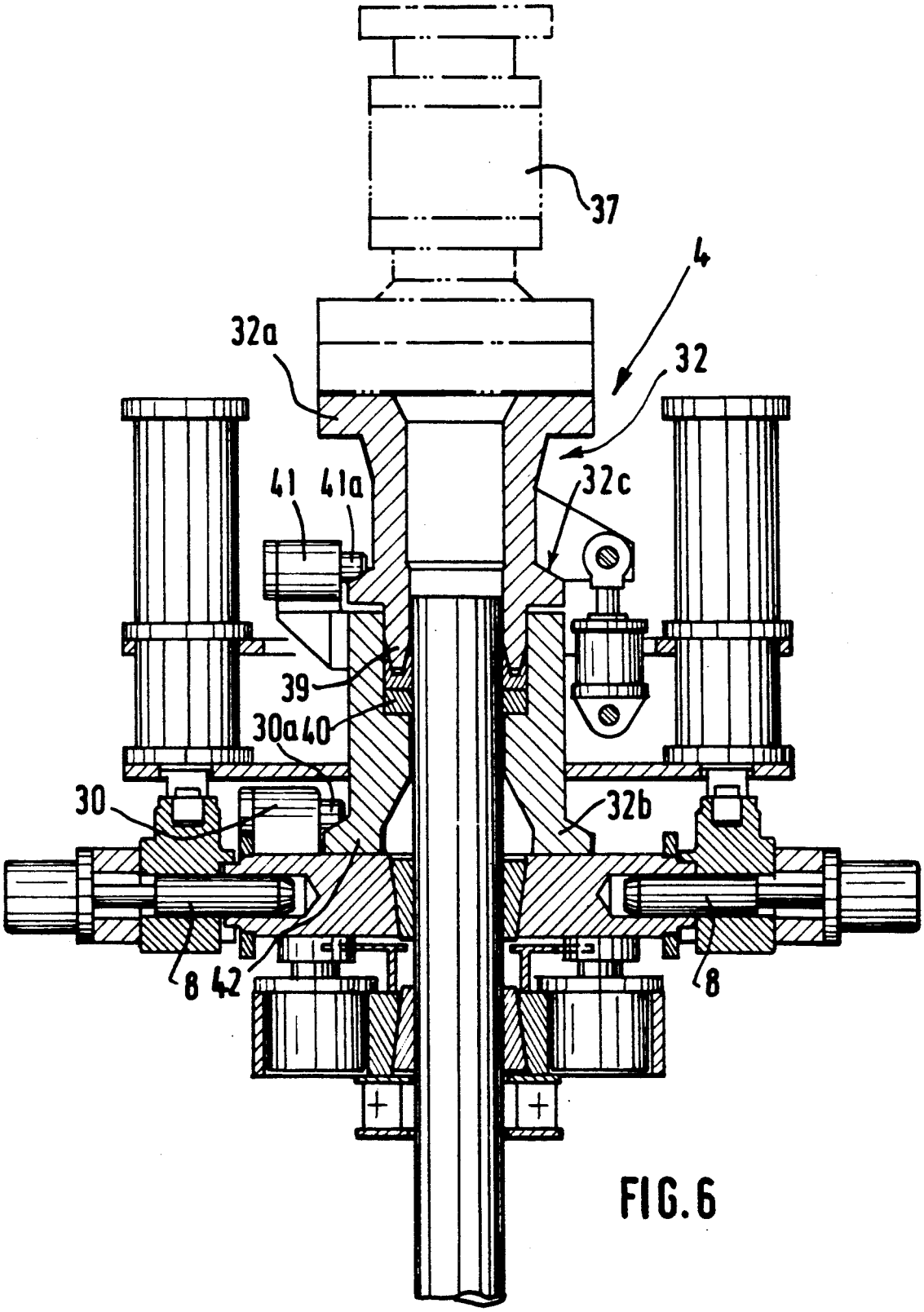

FIG. 1 is an illustrative schematic of capping a blow-out well in the manner of the prior art, FIG. 2 is an overall schematic of the equipment of the invention in a first embodiment mode, FIG. 3*a* is a longitudinal section of the lower collar of the well anchoring system, FIG. 3*b* is a topview corresponding to the drawing of FIG. 3*a*, FIG. 4*a* is a longitudinal section of the anchoring system, FIG. 4*b* is topview corresponding to the drawing of FIG. 4*a*, FIG. 5 is the inclinable and mobile positioning system of the capping system, FIG. 6 shows how the sealing means are put in place on the casing, FIGS. 3 through 6 relate to the embodiment mode of FIG. 2 which herein is called the invention's first embodiment.

Figures 7, 8:
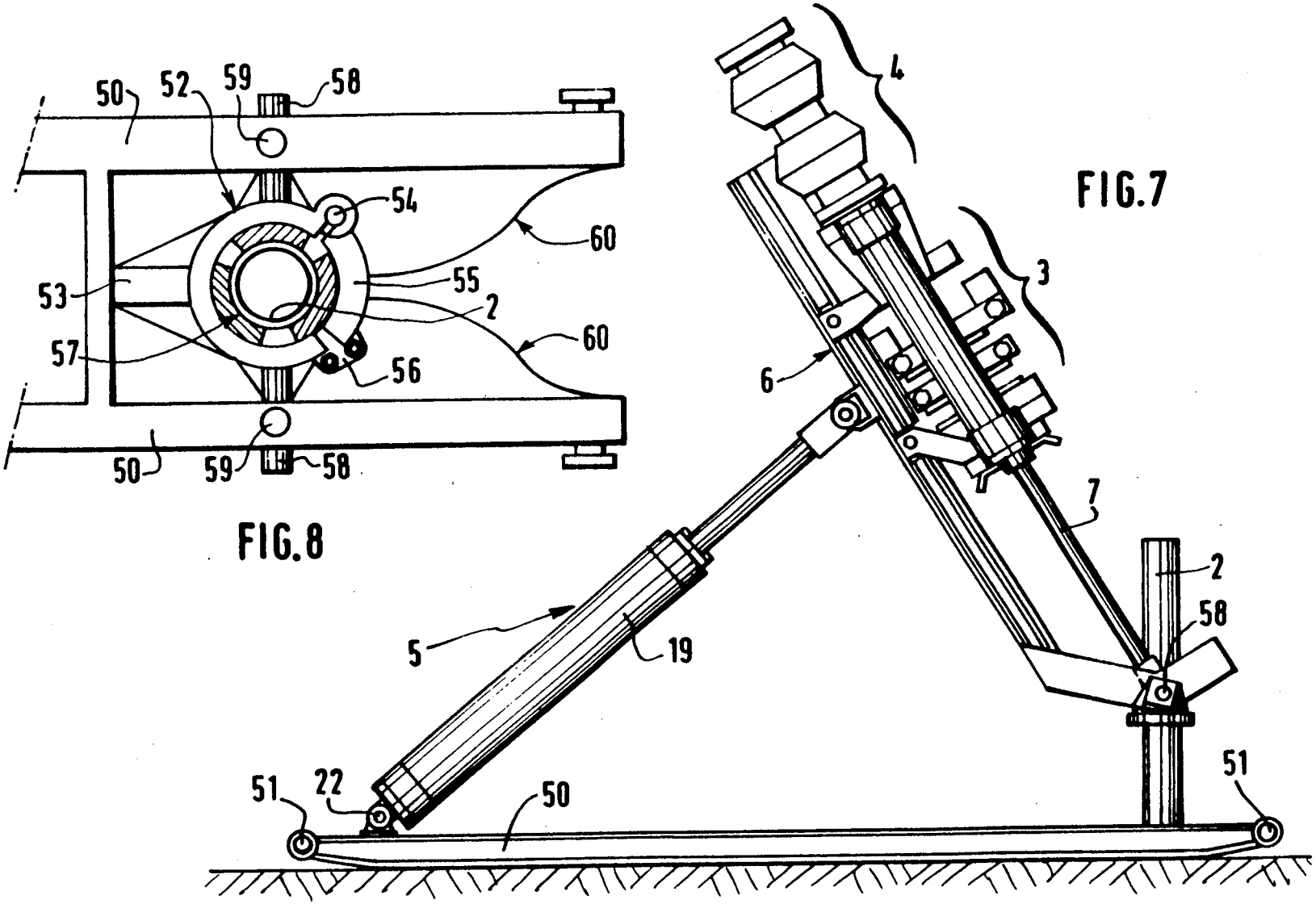

FIG. 7 is an overall schematic of a second embodiment mode of the invention, FIG. 8 is a topview of the system affixing the frame onto the casing to be sealed within the scope of the equipment of FIG. 7.

Before an embodiment of the present invention shall be described, the most frequently capping procedure of the prior art shall be discussed in relation to the schematic of FIG. 1.

In case of blowout, the first step is to cut by remote control and in known manner the casing 100 in order to remove the upper part, that is, the production wellhead in the case of a producing well or the drilling head if drilling is involved. After the cutting indicated by the upper edge 109, the attempt is made to clear, over a sufficient height, a segment of outstanding casing which is in good shape and strong: this can be done by digging the trench 110 around the string issuing over the required depth schematically shown by the dimension h. Accordingly various casings 101, 102 for instance are in the open in the form of a liner called the intermediate production casing denoted by 100 which is clear over a sufficient height. An anchoring system 103 with means for anchoring on the upper cleared height of the drilling head and with seals is affixed to this intermediate casing. Using a self-propelled vehicle 104 with boom and a winch and pulley mechanism 105, the sealing block 106 is moved on the upper side 107 of the anchoring system 103. A first flange 108 is moved by operators or specialists into the sealing-block position shown by short dashed lines in FIG. 1. This manual operation entails grave dangers. Next the sealing assembly 106 is slipped onto the upper side 107 of the anchorage system by rotating it around the unlocked flange 108 so it be axial with the gushing production casing.

Be it borne in mind that the locking of the flange 108 and also the locking of the other omitted flanges of the sealing block centered on the production casing are operations carried out at least in part manually by operators which in this procedure also run severe risks. In the same way, the anchoring collar previously placed in two half-collars entails human intervention to lock these two halves. Accordingly a sequence of very dangerous operations takes place, yet without achieving sealing, mainly because of lack of alignment between the seal and the casing of the well. This major drawback is overcome by the equipment which is the object of the present invention.

FIG. 2 is the overall schematic showing the structure and the principle of operation of the capping equipment of the present invention.

There is no need to describe the preliminary operations known in the art and of which the purpose is to sever the surface elements of the production well and to prepare the casing issuing from the ground over a sufficient length, this casing being denoted by 2 in FIG. 2.

In the previously described illustration, the production casing 2 was previously cleared over a height of 1.300 meters. It was properly recut and chamfered using an automatic rotary machine driven by compressed air but omitted from the drawing.

The equipment of the invention comprises three main cooperating parts: a system for anchoring on the well and denoted by 3, a capping system denoted by 4 and an inclinable and mobile system positioning the capping system and denoted by 5.

The well anchoring system is elucidated not only by FIG. 2 but also and mainly by the details of FIGS. 3 and 4.

The well anchoring system comprises a support collar 9 and a collar 10 for anchoring on the casing.

The support collar 9 consists of two parts in the form of two rapid-connect half-rings. This collar shall act as rest plane for the actual anchoring components by means of its plane upper side 9*a* (FIG. 3*a*). The collar 10 for anchoring on the casing is mounted directly above the support collar. This anchoring collar consists of two axially abutting parts, namely a first part or lower anchoring collar 11 (especially FIGS. 3*a* and 3*b*) and a second part or upper anchoring collar 12. The lower anchoring collar 11 in turn is composed of two semi-annular parts 11*a* and 11*b* linked by eye draw-bolts 25*a* and 25*b*. It comprises two schematically shown jacks 26*a* and 26*b* connected to an omitted hydraulic power station for remote control. These two jacks control the emplacement of the anchoring chocks 27 in a manner discussed below. Furthermore a yoke 28 is provided of which the upper side 28*a* provides the support for the emplacement of the upper collar 12.

The upper collar is shown in the drawing of FIGS. 4*a* and 4*b*. This upper anchoring collar 12 also consists of two semi-annular parts 12*a* and 12*b*. Anchoring chocks 29, of which eight are shown in FIG. 4*b*, are inserted between the outer wall of the casing 2 and the inner diameters of the two parts 12*a* and 12*b* of the upper anchoring collar. The upper part of the upper anchoring collar is equipped with an automatic hydraulic connector serving to affix the sealing block of the capping system denoted by the overall reference 4. This automatic hydraulic connector comprises four jacks 30 (FIGS. 4*b*, 6) of which the thrust shafts are radial along two perpendicular diameters and of which the free ends 30*a* (FIG. 6) shall rest against the anchoring flange 42 of the capping bell 32 in order to achieve locking in a manner described below.

These hydraulic jacks 30 also are connected to the omitted hydraulic power station. Also, the upper anchoring collar 12 comprises two side bosses 31*a* and 31*b* fashioned in suitable manner and serving to receive the alignment shafts 8 (FIG. 6) and supporting displacement means and allowing the capping system 4 to pivot on the anchoring system assembly 3. As shown by FIG. 4*b*, the two side bosses 31*a* and 31*b* are machined so as to permit automatic positioning and hinging of the inclinable and mobile apparatus positioning the capping system 5.

Presently referring to the drawing of FIG. 5, the inclinable and mobile system for positioning the capping system 5 will be described.

It includes in the first place an articulating movable assembly which can be put together on site and essentially comprises a slide ramp 6, a brace 19 and a stay 20, the slide ramp itself consisting of two parallel rails 6*a* and 6*b*. This slide ramp can be inclined to the horizontal using the brace 19 and the stay 20, both of variable lengths which are set telescopically, for instance by means of hydraulic jacks which also are remote-controlled, the brace and the stay hinging on a common point 22 affixed to a base plate 21 resting on the ground and allowing good seating and high stability and avoiding the generation of a bending torque on this end of the pipes. The capping system comprising the capping bell 32 and the adapter bush 37 can slide along the guide rails 6*a*, 6*b* driven in translation by two jacks 33 with mobile plungers 34 of which the ends are in the shape of brackets. Such a bracket 35 shall rest against the corresponding boss 31*a* or 31*b* of the upper anchoring collar 12. Another hydraulic-jack system schematically denoted by 36 allows orienting or pivoting the entire capping system relative to the plane of the slide ramp 6. The capping bell 32 supports the omitted well sealing-block linked to said bell by a tubular sleeve or "spool" 37. The present application does not describe in detail the well sealing block: it consists of the known assembly of sealing means of variable geometries depending on the kind of blowout which are put on the wellhead and permit sealing it. which most of the time are called BOP (blowout preventers). Similarly the flanged tubular muff 37 is known per se and not described, being a short pipe stub with two flanges.

The movable parts 34 of the jacks 33 controlling the motion of the capping assembly on the slide ramp are guided by rests 43 rigidly joined to the slide ramp. The pivot jacks 36 of the capping assembly are mounted by their hinging pistons 45 to a point 44 on the slide ramp.

FIG. 6 shows the capping bell 32 on the anchoring system. The capping bell 32 comprises two coaxial parts 32*a* and 32*b*. The two parts shall be pressed against each other and are separated by the sealing means. These sealing means comprise an annular projection or extension 39 on the lower part of the upper part 32*a* of the capping bell and an annular seal 40 mounted on the casing and in a groove of the lower part 32*b* of the capping bell. When the lower and upper parts 32*a* and 32*b* approach each other, the seal 40 is compressed by the pressure from the projection 39 and perfect sealing is thereby achieved. This nearing of the two parts of the capping bell is made possible by the hydraulic jacks 41 connected in the manner of all jacks of the equipment of the present invention to a hydraulic power station omitted from the drawing. The movable end 41*a* of these jacks 41 is applied against the inclined surface 32*c* of the collar-shaped flange at the base of the upper part 32*a* of the capping bell 32, thus ensuring its centering as shown on FIG. 6. The annular sealing assembly 39, 40 preferably shall be a metal seal which when crushed by the thrust of the hydraulic jacks shall seal the capping bell to the casing.

The equipment operates as follows: after part of the casing 2 was cleared with respect to the ground 1 over a sufficient height as already discussed above, and after it has been suitably cut and chamfered using a remote-controlled rotary machine, the first operation is in emplacing the two-part support-collar 9 which shall be the foundation for and the supporting plane 9*a* of the anchoring-collar components 11 and 12.

First the lower anchoring collar 11 is mounted on the supporting plane 9*a* of the support collar 9, this lower collar 11 to serve later as the seating support to the upper collar 12 using the yoke. The upper collar, which also is in two parts, is then mounted on the casing 2. First the two hydraulic jacks of the lower anchoring collar are pressurized. This step serves to affix the lower and upper collars to the outside wall of the casing by chock anchoring. The hydraulic jacks are supplemented with screw jacks allowing to shut off the pressure following jack anchoring and thus to secure permanent system anchoring reliability. The assembly of mobile and inclining system of the capping system 5 essentially consists of a slide ramp 6, the brace 19, the stay 20, and the base plate, and it is moved on site and its operation is checked. The capping bell 32 with the extension 37 on top of it and also the sealing block (BOP) is moved onto the horizontal guide rail. Next the capping bell is mounted on its cradle, the two approach jacks 7 being pressurized, that is, their rods are fully extended. The free ends 34 of the equipment jacks and comprising the brackets 35 snap onto the lateral bosses of the upper collar, rigorously speaking on the alignment shafts 8.

The slope of the slide ramp is arbitrarily adjusted by telescoping the brace 19 and/or the stay 20. The capping assembly on the slide ramp resting against the anchoring system 3 is displaced along the plane of the slide ramp or is pivoted with respect to it by means of displacement jacks 7 or pivoting jacks 36, all these jacks being remote-controlled to bring the capping assembly into a position coaxial with and above the upper end of the casing 2.

Again by remote-control of the displacement jacks 7, the capping bell 32 is snapped in position on the casing 2 until it abuts the upper side of the anchoring system 3. The capping assembly then is locked in position on the anchoring assembly using the jacks 30.

The two parts 32*a* and 32*b* of the capping bell then are moved towards each other and the seal is thus made effective on the casing by crushing the joint 40 by means of the jacks 41 with plungers 41*a*. The adapter sleeve 37 and the sealing block (known per se) with sealing jaws are in place at this time. The capping of the blowout well has been achieved without human intervention because all the steps implemented hydraulically are so by remote control.

FIGS. 7 and 8 illustrate a variation of the equipment of the invention with total absence of human intervention.

Those mechanical components of the above described embodiment that are unchanged in the present one shall retain their numerals.

As shown by FIG. 7, the means for moving near the capping system consists of a frame 50 also called "skid". This skid is provided at its front and rear ends with flanges 51 to receive loading slings. These same flanges will prevent any skid locking in the case of ground obstacles, in particular in the event of an abrupt rise. Be it noted that in principle these flanges 51 do not touch the ground. The loading slings—or rigging—are held in place by the raised end consisting of these flanges 51. This frame advantageously may consist of two parallel runner-beams inter-connected by several braces. This frame replaces the stay 20 and the base plate 21. Two braces 19 hinge on 22 in a manner similar to that of the previous embodiment mode. The assembly comprising the frame 50, the braces 19 and the slide ramp 6 constitutes the inclinable and mobile position system of the capping system 5.

The end of the frame 50 which shall be opposite the casing 2 to be sealed is shaped by a centering and guiding ramp 60 shown in FIG. 8. This ramp consists of two symmetric surfaces relative to the vertical, longitudinal, median plane of the frame. The frame 50 is moved closer to the casing to be sealed until abutting either of the said ramp-constituting surfaces. In the presence of a longitudinal approach-stress of the frame, this frame will center itself by the matching shape of the ramp 60.

A positioning means to casing 2 is associated with the end of the frame 50 near said casing. This means consists of a housing 52 rigidly joined to the end of the frame 50 by ribs 53. This cylindrical housing encloses tightly the casing 2 over its entire periphery. For that purpose it comprises an access gate 55 capable of pivoting about an opening shaft 54 and which can be locked onto the casing by a locking means 56 known per se and remote-controlled by fluid or mechanical means. Anchoring chocks 57 sectorially distributed on the casing periphery by their axial displacement allow affixing the housing 52 onto the casing. These anchoring chocks can be remote-controlled in known manner and in the same way as a known chock system.

In operation, the mobile positioning system of the capping system 5 is moved against the casing with the gate 55 being open. While abutting the casing, the gate 55 then is closed, the anchoring chocks 57 are moved to assure proper fixation of the housing 52 and consequently of the frame 50 on the casing 2.

Shafts 58 are provided on the shaft-bearings 59 to receive the ends of the displacement jacks 7; the slide ramp 6 and the equipment it supports therefore can pivot about said shafts 58 which serve the same function as the alignment shafts 8 of the first embodiment mode of the invention.

The anchoring system 3 is identical in its structure and the arrangement of its components with the first embodiment mode, but in the second one, it is mounted on the slide ramp 6 like the capping assembly 4. This anchoring system is moved, pivoted and affixed to the casing using a mobile positioning system 5. This anchoring system 3 shall not be discussed further, having been amply described above in relation to the first embodiment mode.

The equipment of the embodiment variation operates as follows:

The inclinable and mobile support and positioning system 5 together with its slide ramp 6 supporting simultaneously the anchoring system 3 and the capping system 4 is remote controlled by any known means acting on the skid, by anchoring the rigging on the flanges 51 etc. and is made to butt against the casing 2. The access gate 55 is closed on the casing, the assembly being fixed in place by the anchoring chocks 57. The slide ramp 6 is moved in the vertical position by being pivoted around the hinge shafts 58 by the jack acting on the brace 19. Thereupon the anchoring system 3 is lowered on the mouth of the casing together with the capping system (fitting and BOP) denoted by 4.

The emplacement of the anchoring system 3, that is the support collar 9 and of the lower anchoring collar 11 of the upper anchoring collar 12 is performed as in the first embodiment except for the changes already considered.

The remote-control fluid means as a rule are known to the expert. Such equipment consists of a hydraulic power station generating the fluid pressure, a control and repairs desk channelling this fluid to the desired operation, and a network of conduits moving this pressurized fluid to the component which shall carry out the particular control function.

This hydraulic power station may be located a substantial distance away to meet constraints of safety relating to the approaches of the well during operation.

The hydraulic power station also may be supplemented by a set of storage batteries to store the required hydraulic energy to control the various components serving the diverse functions.

Similarly the control desk may be on site or if called for some distance away to meet safety requirements around the well.

We claim:

1. Capping equipment for a freely gushing blowout well used for emplacing well-sealing means on the top of a well casing, which was previously cleared from the ground surrounding a platform, comprising:

a well capping system to seal the well-casing, an anchoring system locked onto the well-casing by locking means for supporting the well capping system, and an inclinable and mobile support and positioning system for assisting in the emplacement of the well capping system on the top of the well-casing, including a mobile inclinable slide ramp, displacement means for moving the well capping system on this slide ramp, and pivoting and positioning means for pivoting said well capping system and positioning it above the end of the well casing to be sealed; the anchoring system, said locking means for the anchoring system, the displacement means and the pivoting and positioning means of the well capping system being remote-controlled fluid means, wherein the anchoring system is locked on a lower part of a cleared and projecting end of the well-casing and the means pivoting the capping system hinge on a stationary component rigidly joined to the anchoring system and wherein the mobile, inclinable slide ramp is mounted on a brace and a stay which hinge on one anchoring point of a face plate resting on the ground.

2. Equipment defined in claim 1, wherein the stationary component solidly joined to the anchoring system consists of two alignment shafts in extension of said anchoring system which cooperate with at least one end of the displacing and pivoting means of the capping system.

3. Equipment defined in claim 1, wherein the anchoring system includes a support collar acting as a support plane for an anchoring collar when deposited on the well-casing.

4. Equipment defined in claim 3, wherein the anchoring collar to the casing comprises two parts: a lower anchoring collar and an upper anchoring collar, the two collars being affixed to the casing by chock anchoring, said chocks being driven by remote-controlled hydraulic jacks.

5. Equipment defined in claim 1, wherein the capping system comprises a capping bell with an anchoring flange which is pressed against the upper side of an anchoring collar, and is locked to it by locking jacks acting on the anchoring flange.

6. Equipment defined in claim 1, wherein the displacement means of the capping system on the slide ramp consist of jacks having free ends which rest against the stationary component of the anchoring system.

7. Equipment defined in claim 6, wherein said free ends of the displacement jacks are shaped as brackets resting against alignment shafts included within the anchoring system.

8. Equipment defined in claim 1, wherein the means pivoting the capping system around a horizontal shaft are pivoting jacks mounted by one of their ends to a hinge means rigidly joined to the slide ramp.

9. Equipment defined in claim 5, wherein the capping bell is composed of two coaxial parts mounted one on the other and including means for sealing the two coaxial parts on the casing.

10. Equipment for capping a blowout well, defined in claim 1, wherein said capping system and said anchoring system are mounted together on the slide ramp and are rigidly joined to each other in translation.

11. Capping equipment defined in claim 10, wherein the inclinable and mobile support and positioning system of the capping system and of the anchoring system on the slide ramp is mounted on a frame which can be displaced by remote-controlled means.

12. Capping equipment defined in claim 10, wherein a joint is provided at the front end of the frame by clamping tight the casing to be sealed, said joint being rigidly affixed to said frame.

13. Capping equipment defined in claim 12, wherein the clamped joint consists of a housing with an access gate to clamp the casing.

14. Capping equipment defined in claim 13, wherein anchoring chocks are present against the casing and the housing to fix the joint in place by clamping against the casing.

15. Equipment defined in claim 12, wherein the clamped joint comprises hinge shafts to pivot the slide ramp of the inclinable and mobile support and positioning system.

16. Equipment defined in claim 1, wherein said free ends are plungers.

* * * * *